US011655942B2

(12) United States Patent
Yoon

(10) Patent No.: US 11,655,942 B2
(45) Date of Patent: May 23, 2023

(54) WASTE HYDROGEN RECOVERY DEVICE OF EVALUATION DEVICE OF HYDROGEN REFUELING STATION

(71) Applicants: Hyundai Motor Company, Seoul (KR); Kia Corporation, Seoul (KR)

(72) Inventor: A Eun Yoon, Gyeonggi-do (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 0 days.

(21) Appl. No.: 17/479,528

(22) Filed: Sep. 20, 2021

(65) Prior Publication Data

US 2022/0290811 A1 Sep. 15, 2022

(30) Foreign Application Priority Data

Mar. 11, 2021 (KR) ..... 10-2021-0031901

(51) Int. Cl.
*F17C 7/00* (2006.01)
*F17C 13/04* (2006.01)

(52) U.S. Cl.
CPC ..... *F17C 7/00* (2013.01); *F17C 13/04* (2013.01); *F17C 2205/0332* (2013.01); *F17C 2221/012* (2013.01); *F17C 2227/0157* (2013.01); *F17C 2227/044* (2013.01); *F17C 2250/043* (2013.01); *F17C 2250/0636* (2013.01); *F17C 2260/035* (2013.01)

(58) Field of Classification Search
CPC .... F17C 7/00; F17C 13/04; F17C 2205/0332; F17C 2221/012; F17C 2227/0157; F17C 2227/044; F17C 2250/043; F17C 2250/0636; F17C 2260/035
USPC ..... 141/192
See application file for complete search history.

(56) References Cited

U.S. PATENT DOCUMENTS 9,977,005 B2 * 5/2018 Carteau ..... G01N 33/22
10,502,649 B1 * 12/2019 Cohen ..... B65D 83/14
11,306,873 B2 * 4/2022 Lee ..... F17C 5/007
(Continued)

FOREIGN PATENT DOCUMENTS

KR 102070948 B1 * 4/2020
KR 102070948 B1 4/2020

OTHER PUBLICATIONS

KR-102070948-B1 English Translation of Specification (Year: 2022).*

*Primary Examiner* — Timothy P. Kelly
*Assistant Examiner* — Stephanie A Shrieves
(74) *Attorney, Agent, or Firm* — Fox Rothschild LLP

(57) ABSTRACT

A waste hydrogen recovery device of an evaluation device of a hydrogen refueling station includes: a buffer container connected to a discharge pipeline of the evaluation device; a flow path switching valve installed at a hydrogen supply side of the hydrogen refueling station and installed to selectively form a flow path flowing hydrogen from one of a hydrogen supply source or the buffer container into the hydrogen refueling station; and a controller provided to control a tank protection valve installed between an inflow pipeline and a discharge pipeline of the evaluation device, and the controller further provided to control a hydrogen tank, a discharge valve installed on the discharge pipeline, the flow path switching valve, and a compressor of the hydrogen refueling station.

8 Claims, 3 Drawing Sheets

(56) References Cited

U.S. PATENT DOCUMENTS

| | | | | |
|---|---|---|---|---|
| 2013/0248000 | A1* | 9/2013 | Killeen | F17D 3/00 251/304 |
| 2014/0216599 | A1* | 8/2014 | Loewenthal | F17C 5/00 141/4 |
| 2020/0386369 | A1* | 12/2020 | Ito | H01M 8/04664 |
| 2022/0307650 | A1* | 9/2022 | Yoon | F17C 13/025 |

* cited by examiner

WASTE HYDROGEN RECOVERY DEVICE OF EVALUATION DEVICE OF HYDROGEN REFUELING STATION

CROSS REFERENCE TO RELATED APPLICATION

The present application claims under 35 U.S.C. § 119(a) the benefit of Korean Patent Application No. 10-2021-0031901 filed on Mar. 11, 2021, the entire contents of which are incorporated by reference herein.

BACKGROUND

(a) Technical Field

The present disclosure relates to an evaluation device for evaluating a hydrogen refueling station for charging hydrogen in a vehicle or the like.

(b) Description of the Related Art

A hydrogen refueling station should satisfy an international standard refueling protocol, and an evaluation device is used for confirming whether the hydrogen refueling station satisfies the protocol.

The evaluation device is equipment for simulating an object into which hydrogen is to be charged by the hydrogen refueling station, such as a hydrogen vehicle.

The evaluation device is provided to test the hydrogen refueling station in which there is a possibility of hydrogen remaining therein. In particular, hydrogen has a property of causing hydrogen embrittlement, thus causing weakening as it is absorbed into a metal material to change a metal lattice, and the remaining hydrogen may cause a hydrogen purity measurement error in a subsequent hydrogen refueling station test and cause an accident after improvement or repair of the evaluation device, such that the hydrogen inside the evaluation device may be purged.

The conventional hydrogen purge of the evaluation device uses a method for discharging the hydrogen existing within the evaluation device to the atmosphere, and in this case, the hydrogen discharged to the atmosphere may be regarded as being wasted unnecessarily.

Further, to discharge the hydrogen to the atmosphere from the evaluation device as described above, the evaluation device is generally moved to a place where hydrogen may be discharged, and in this case, separate manpower and cost are required for moving the evaluation device or the like.

The foregoing explained as the background is intended merely to aid in the understanding of the background of the present disclosure, and is not intended to mean that the present disclosure falls within the purview of the related art that is already known to those skilled in the art.

SUMMARY

An object of the present disclosure is to provide a waste hydrogen recovery device of an evaluation device of a hydrogen refueling station, which may recover hydrogen within an evaluation device of a hydrogen refueling station to the hydrogen refueling station without being improperly discharged to the atmosphere to prevent waste of the hydrogen and to avoid costs associated with separate manpower typically required to move the evaluation device to a place where the hydrogen may be discharged, thereby greatly reducing the overall cost for the evaluation work of the hydrogen refueling station.

A waste hydrogen recovery device of an evaluation device of a hydrogen refueling station for achieving the object is configured to include a buffer container connected to a discharge pipeline of an evaluation device; a flow path switching valve installed at a hydrogen supply side of a hydrogen refueling station and installed to selectively form a flow path flowing hydrogen from one of a hydrogen supply source or the buffer container into the hydrogen refueling station; and a controller provided to control a tank protection valve installed between an inflow pipeline and a discharge pipeline of the evaluation device, and a hydrogen tank, a discharge valve installed on the discharge pipeline, the flow path switching valve, and a compressor of the hydrogen refueling station.

Upon the hydrogen purge of the evaluation device, the controller may be configured to control the tank protection valve to form a state of communicating all of the inflow pipeline, the discharge pipeline, and a hydrogen tank, and to open the discharge valve of the discharge pipeline.

The controller may be configured to operate the flow path switching valve such that the hydrogen from the buffer container may be supplied to the hydrogen refueling station, when a pressure difference between the buffer container and the evaluation device is reduced to a predetermined reference pressure difference or less by opening the discharge valve, and to suck the hydrogen of the buffer container into the hydrogen refueling station by driving the compressor of the hydrogen refueling station.

The waste hydrogen recovery device of the evaluation device of the hydrogen refueling station may further include an interruption valve for interrupting a flow path provided between the discharge pipeline and the buffer container.

The controller may be configured to control the interruption valve.

Upon the hydrogen purge of the evaluation device, the controller may be configured to control the tank protection valve to form a state of communicating all of the inflow pipeline, the discharge pipeline, and the hydrogen tank, and to open the discharge valve of the discharge pipeline and the interruption valve.

The controller may be configured to operate the flow path switching valve such that the hydrogen from the buffer container may be supplied to the hydrogen refueling station, when a pressure difference between the buffer container and the evaluation device is reduced to a predetermined reference pressure difference or less by opening the discharge valve and the interruption valve, and to suck the hydrogen of the buffer container into the hydrogen refueling station by driving the compressor of the hydrogen refueling station.

The controller may be configured to stop the compressor and close the interruption valve when a pressure of the discharge pipeline of the evaluation device is reduced to the predetermined reference pressure or less.

The present disclosure may recover the hydrogen within the evaluation device of the hydrogen refueling station to the hydrogen refueling station without being improperly discharged to the atmosphere to prevent waste of the hydrogen and to avoid costs associated with separate manpower typically required to move the evaluation device to a place where the hydrogen may be discharged, thereby greatly reducing the overall cost for the evaluation work of the hydrogen refueling station.

BRIEF DESCRIPTION OF THE DRAWINGS

The above and other objects, features and other advantages of the present disclosure will be more clearly understood from the following detailed description when taken in conjunction with the accompanying drawings, in which.

DETAILED DESCRIPTION OF THE DISCLOSURE

Figure 1:
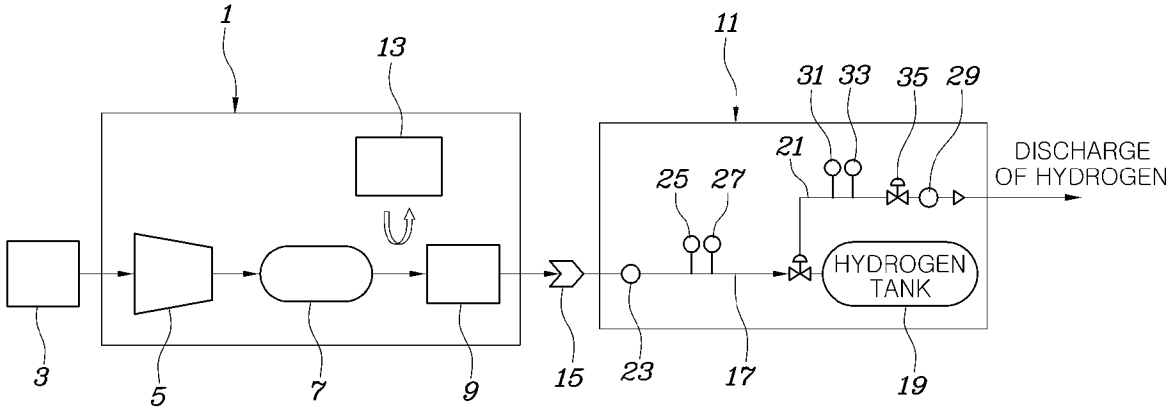
FIG. 1 is a diagram explaining a conventional hydrogen refueling station to which the present disclosure is applicable and a connection structure of an evaluation device thereof.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Specific structural to functional descriptions of the exemplary embodiments of the present disclosure disclosed in the present specification or application are only illustrated for the purpose of describing the exemplary embodiments according to the present disclosure, and the exemplary embodiments according to the present disclosure may be embodied in various forms and it should not be construed that the present disclosure is limited to the exemplary embodiments described in the present specification or application.

Since the embodiments according to the present disclosure may be variously changed and have various forms, specific exemplary embodiments will be illustrated in the drawings and described in detail in the present specification or application. However, this is not intended to limit the exemplary embodiments according to the concept of the present disclosure to a particular disclosed form, and it should be understood that the present disclosure includes all changes, equivalents, and substitutes included in the spirit and scope of the present disclosure.

Terms such as first and/or second may be used to describe various components, but the components should not be limited by the terms. The terms are used only for the purpose of distinguishing one component from another, and for example, without departing from the scope according to the concept of the present disclosure, the first component may be named a second component, and similarly, the second component may also be named the first component.

When a component is referred to as being "connected" or "coupled" to another component, the component may be directly connected or coupled to another component, but it should be understood that other components may also be present between the components. On the other hand, when a component is referred to as being "directly connected" or "directly coupled" to another component, it should be understood that there are no other components between the components. Other expressions which describe the relationship between the components, that is, "between" and "immediately between" or "neighboring" and "directly neighboring to" should be interpreted in the same manner.

The terminology used in the present specification is merely for the purpose of describing particular exemplary embodiments, and is not intended to limit the present disclosure. The singular forms may include plural forms unless the contexts clearly indicate the opposite.

Unless defined otherwise, all terms including technical terms or scientific terms used herein have the same meaning as commonly understood by those skilled in the art to which the present disclosure pertains. The terms defined in the dictionary commonly used may be interpreted as having a meaning consistent with the meaning in the context of the related technology, and may not be interpreted as an ideal or excessively formal meaning, unless clearly defined in the present specification.

Hereinafter, a preferred exemplary embodiment of the present disclosure will be described with reference to the accompanying drawings to specifically describe the present disclosure. The same reference numerals indicated in each drawing refer to the same members.

Referring to FIG. 1, a hydrogen refueling station 1 is configured to receive hydrogen from a hydrogen supply source 3, configured to compress the received hydrogen by a compressor 5, to store it in a storage container 7, and to supply the hydrogen to an evaluation device 11 through a dispenser 9. In particular, the hydrogen refueling station 1 may be provided with a cooler 13 for cooling heat by a Joule-Thomson effect generated by the hydrogen passing through the dispenser 9.

The evaluation device 11 is configured to receive hydrogen from the hydrogen refueling station 1 through a socket 15, to store it in a hydrogen tank 19 through an inflow pipeline 17, and to discharge the hydrogen to the outside through a discharge pipeline 21 connected to the hydrogen tank 19.

The evaluation device 11 is provided with an inflow flow rate meter 23, an inflow temperature sensor 25, and an inflow pressure sensor 27 for measuring the flow rate, temperature, and pressure of the hydrogen passing through the inflow pipeline 17, and the discharge pipeline 21 is provided with a discharge flow rate meter 29, a discharge temperature sensor 31, and a discharge pressure sensor 33 for measuring the flow rate, temperature, and pressure of the discharged hydrogen, respectively. Further, the evaluation device 11 may be provided with a discharge valve 35 for opening and closing the discharge pipeline 21.

A tank protection valve 37 may be provided between the inflow pipeline 17, the discharge pipeline 21, and the hydrogen tank 19 to form a state of connecting only the inflow pipeline 17 and the hydrogen tank 19, a state of communicating the inflow pipeline 17 and the discharge pipeline 21 and closing the hydrogen tank 19, and a state of communicating all of the inflow pipeline 17, the discharge pipeline 21, and the hydrogen tank 19.

For reference, the hydrogen supply source 3 may be a hydrogen tube trailer or the like.

Figure 2:
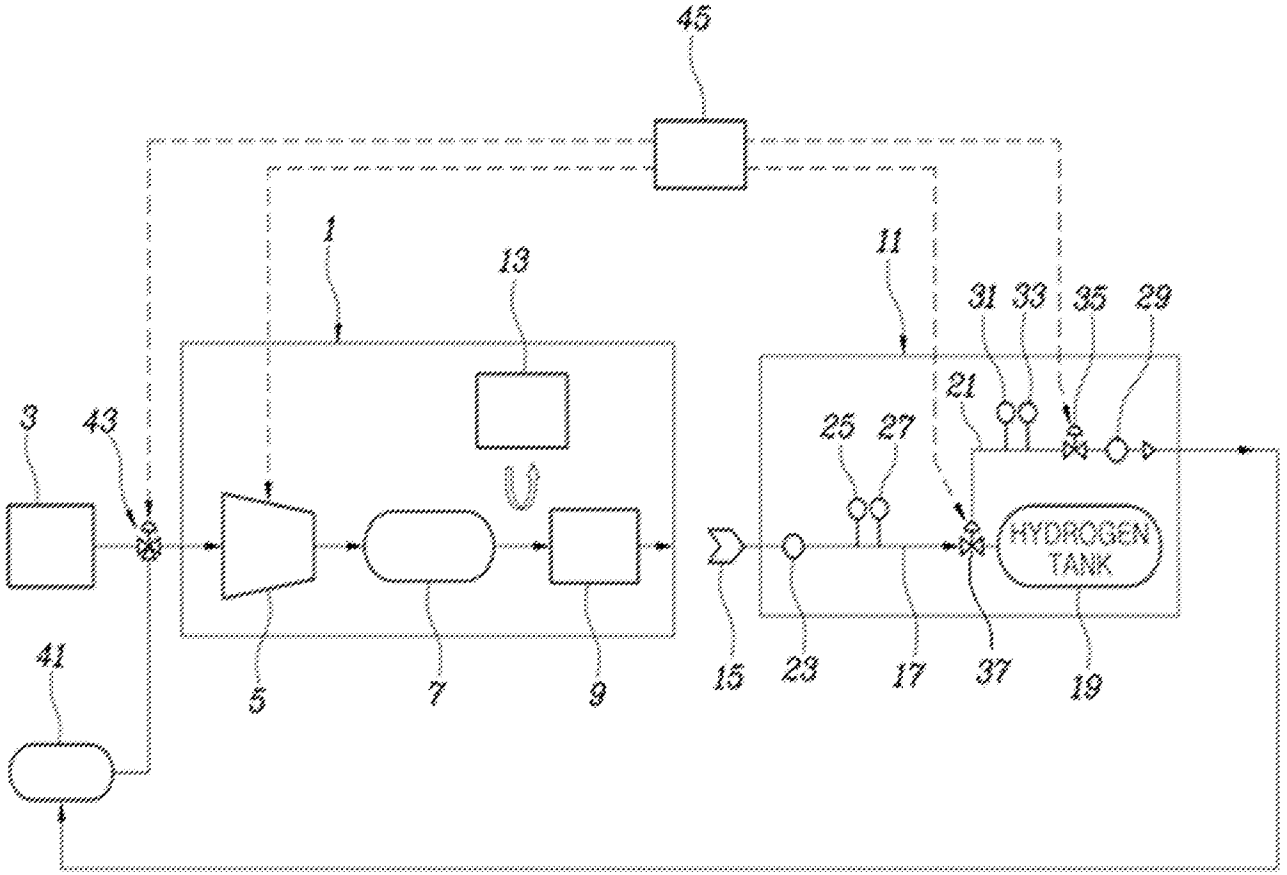
FIG. 2 is a diagram illustrating a first exemplary embodiment of a waste hydrogen recovery device of an evaluation device of a hydrogen refueling station according to the present disclosure.
Figure 3:
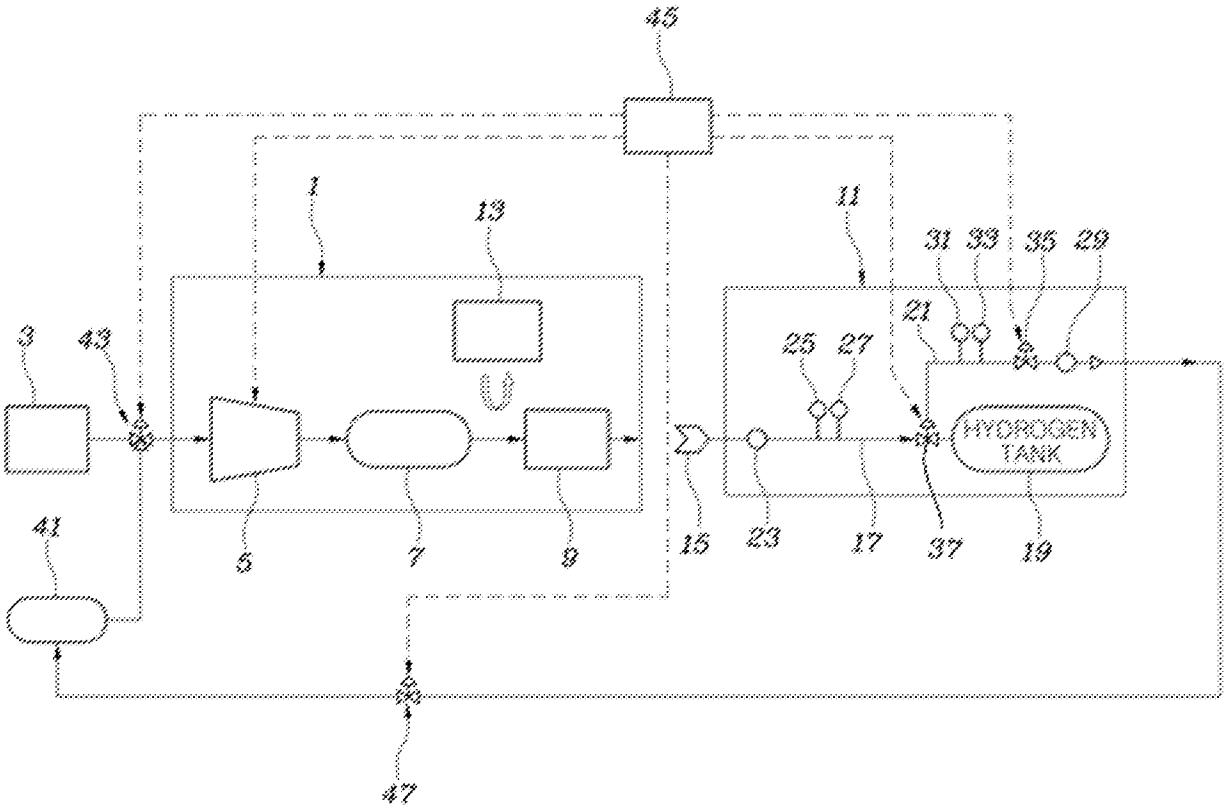
FIG. 3 is a diagram illustrating a second exemplary embodiment of the waste hydrogen recovery device of the evaluation device of the hydrogen refueling station according to the present disclosure.

Referring to FIGS. 2 and 3, exemplary embodiments of the waste hydrogen recovery device of the evaluation device of the hydrogen refueling station according to the present disclosure are commonly configured to include a buffer container 41 connected to the discharge pipeline 21 of the evaluation device 11; a flow path switching valve 43 installed at a hydrogen supply side of the hydrogen refueling station 1 and installed to selectively form a flow path flowing hydrogen from one of the hydrogen supply source 3 or the buffer container 41 into the hydrogen refueling station 1; and a controller 45 provided to control a tank protection valve 37 installed between the inflow pipeline 17 and the discharge pipeline 21 of the evaluation device 11, and the hydrogen tank 19, the discharge valve 35 installed on the discharge pipeline 21, the flow path switching valve 43, and the compressor 5 of the hydrogen refueling station 1.

That is, the exemplary embodiments of the present disclosure are configured to finish the use of the evaluation device 11 of the hydrogen refueling station 1, and to recover the hydrogen discharged from the evaluation device 11 to the hydrogen refueling station 1 through the buffer container 41 upon the purge discharging the hydrogen inside the evaluation device 11.

Therefore, conventionally, upon the purge of the evaluation device 11, by recovering the hydrogen discharged to the atmosphere and uselessly wasted back to the hydrogen refueling station 1, it is possible to reduce the cost due to the discharge of the hydrogen to the atmosphere and to also exclude the manpower and cost required for moving the evaluation device 11 to an area where the hydrogen may be discharged to the atmosphere in order to discharge the hydrogen of the evaluation device 11 to the atmosphere, conventionally.

Upon the hydrogen purge of the evaluation device 11, the controller 45 is configured to control the tank protection valve 37 to form the state of communicating all of the inflow pipeline 17, the discharge pipeline 21, and the hydrogen tank 19, and to open the discharge valve 35 of the discharge pipeline 21.

Therefore, hydrogen at all positions within the evaluation device 11 moves to the buffer container 41 through the discharge pipeline 21.

The buffer container 41 forms a state of having discharged the air inside in advance as a state similar to vacuum before the hydrogen purge starts, such that when the tank protection valve 37 and the discharge valve 35 are opened, a significant amount of hydrogen within the evaluation device 11 may flow into the buffer container 41 by itself by a pressure difference.

The controller 45 is configured to operate the flow path switching valve 43 such that the hydrogen from the buffer container 41 may be supplied to the hydrogen refueling station 1, when a pressure difference between the buffer container 41 and the evaluation device 11 is reduced to a predetermined reference pressure difference or less by opening the discharge valve 35, and to suck the hydrogen of the buffer container 41 to the hydrogen refueling station 1 by driving the compressor 5 of the hydrogen refueling station 1.

That is, when the hydrogen starts to move from the evaluation device 11 to the buffer container 41 by the pressure difference by opening the discharge valve 35 of the evaluation device 11 and then the time elapses, the pressure difference between the evaluation device 11 and the buffer container 41 is gradually reduced, such that when the pressure difference becomes the reference pressure difference or less and the hydrogen does not smoothly move any more by the pressure difference, as described above, the buffer container 41 is connected to the hydrogen refueling station 1 by the flow path switching valve 43, and the compressor 5 is driven to forcibly suck the hydrogen of the buffer container 41 into the hydrogen refueling station 1.

Therefore, the reference pressure difference is preferably set at a level of determining whether a hydrogen purge time will be excessively taken because it is difficult to smoothly move the hydrogen by only the pressure difference between the evaluation device 11 and the buffer container 41 according to the aforementioned object, and may be determined by design through a number of experiments and analyses.

When the hydrogen purge work is performed as described above, as described above, there is little discharge of the hydrogen to the atmosphere even while the purge is performed by sufficiently discharging the hydrogen within the evaluation device 11, thereby removing a waste factor due to unnecessary discharge of the hydrogen to the atmosphere, and costs such as the manpower required for moving the evaluation device 11 to another location for discharging the hydrogen to the atmosphere.

FIG. 3 illustrates a second exemplary embodiment of the waste hydrogen recovery device of the evaluation device 11 of the hydrogen refueling station 1 according to the present disclosure, and there is a difference in that an interruption valve 47 for interrupting a flow path is further provided between the discharge pipeline 21 and the buffer container 41.

According to the present exemplary embodiment, the controller 45 is configured to control the interruption valve 47.

The interruption valve 47 may also be configured to be manually opened and closed by the manpower rather than an automatic control by the controller 45.

Upon the hydrogen purge of the evaluation device 11, the controller 45 is configured to control the tank protection valve 37 to form a state of communicating all of the inflow pipeline 17, the discharge pipeline 21, and the hydrogen tank 19, and to open the discharge valve 35 of the discharge pipeline 21 and the interruption valve 47.

That is, since the hydrogen of the evaluation device 11 may be moved to the buffer container 41 only when the interruption valve 47 as well as the discharge valve 35 of the evaluation device 11 is opened, the controller 45 opens the interruption valve 47 together upon the hydrogen purge.

When the pressure difference between the buffer container 41 and the evaluation device 11 is reduced to the reference pressure difference or less by opening the discharge valve 35 and the interruption valve 47, the controller 45 is configured to operate the flow path switching valve 43 such that the hydrogen from the buffer container 41 may be supplied to the hydrogen refueling station 1, and to suck the hydrogen of the buffer container 41 into the hydrogen refueling station 1 by driving the compressor 5 of the hydrogen refueling station 1.

Further, when a pressure of the discharge pipeline 21 of the evaluation device 11 is reduced to a predetermined reference pressure difference or less, the controller 45 is configured to stop the compressor 5 and close the interruption valve 47.

That is, when the pressure of the discharge pipeline 21 of the evaluation device 11 is significantly reduced by driving the compressor 5, such that when it is determined that almost all of the hydrogen of the evaluation device 11 is substantially discharged, the controller 45 causes the hydrogen not to be discharged from the buffer container 41 to the atmosphere when the evaluation device 11 and the buffer container 41 are separated after stopping the compressor 5 and closing the interruption valve 47.

The evaluation device 11 may block the discharge valve 35 to prevent the inflow of the air from the outside, and thereafter, may take steps to prevent the hydrogen embrittlement inside the evaluation device 11 and to store the evaluation device 11 in a stable state through a separate process such as injecting an inert gas or the like.

While the specific exemplary embodiment of the present disclosure has been illustrated and described, it will be apparent to those skilled in the art that the present disclosure may be variously improved and changed without departing from the technical spirit of the present disclosure provided by the appended claims.

What is claimed is:

1. A waste hydrogen recovery device of an evaluation device of a hydrogen charging facility comprising:

a buffer container connected to a discharge pipeline of the evaluation device;

a flow path switching valve installed at a hydrogen supply side of the hydrogen charging facility and installed to selectively form a flow path flowing hydrogen from one of a hydrogen supply source or the buffer container into the hydrogen charging facility;

a tank protection valve installed at a junction between an inflow pipeline, the discharge pipeline and a hydrogen tank of the evaluation device; and a controller provided to control the tank protection valve, a discharge valve installed on the discharge pipeline, the flow path switching valve, and a compressor of the hydrogen charging facility.

2. The waste hydrogen recovery device of the evaluation device of the hydrogen charging facility according to claim 1, wherein upon purging hydrogen from the evaluation device:

the controller is configured to control the tank protection valve to form a state of communicating all of the inflow pipeline, the discharge pipeline, and the hydrogen tank, and the controller is configured to open the discharge valve of the discharge pipeline.

3. The waste hydrogen recovery device of the evaluation device of the hydrogen charging facility according to claim 2, wherein the controller is configured to operate the flow path switching valve such that the hydrogen from the buffer container is supplied to the hydrogen charging facility, when a pressure difference between the buffer container and the evaluation device is reduced to a predetermined reference pressure difference or less by opening the discharge valve, and the controller is configured to suck the hydrogen of the buffer container into the hydrogen charging facility by driving the compressor of the hydrogen charging facility.

4. The waste hydrogen recovery device of the evaluation device of the hydrogen charging facility according to claim 1, further comprising:

an interruption valve for interrupting a flow path provided between the discharge pipeline and the buffer container.

5. The waste hydrogen recovery device of the evaluation device of the hydrogen charging facility according to claim 4, wherein the controller is configured to control the interruption valve.

6. The waste hydrogen recovery device of the evaluation device of the hydrogen charging facility according to claim 5, wherein upon purging hydrogen from the evaluation device:

the controller is configured to control the tank protection valve to form a state of communicating all of the inflow pipeline, the discharge pipeline, and the hydrogen tank, and the controller is configured to open the discharge valve of the discharge pipeline and the interruption valve.

7. The waste hydrogen recovery device of the evaluation device of the hydrogen charging facility according to claim 5, wherein the controller is configured to operate the flow path switching valve such that the hydrogen from the buffer container is supplied to the hydrogen charging facility, when a pressure difference between the buffer container and the evaluation device is reduced to a predetermined reference pressure difference or less by opening the discharge valve and the interruption valve, and the controller is configured to suck the hydrogen of the buffer container into the hydrogen charging facility by driving the compressor of the hydrogen charging facility.

8. The waste hydrogen recovery device of the evaluation device of the hydrogen charging facility according to claim 7, wherein the controller is configured to stop the compressor and close the interruption valve when a pressure of the discharge pipeline of the evaluation device is reduced to the predetermined reference pressure or less.

* * * * *